US005967835A

United States Patent [19]

Daoud

[11] Patent Number: 5,967,835

[45] Date of Patent: Oct. 19, 1999

[54] WIRE WRAP CONNECTION REPAIR DEVICE

[75] Inventor: Bassel Hage Daoud, Parsippany, N.J.

[73] Assignee: Lucent Technologies, Inc., Murray Hill, N.J.

[21] Appl. No.: 09/107,328

[22] Filed: Jun. 30, 1998

[51] Int. Cl.[6] ..... H01R 13/52

[52] U.S. Cl. ..... 439/521; 439/936; 439/888; 174/74 R; 29/857

[58] Field of Search ..... 439/790, 888, 439/521, 936; 174/74 R, 76, 78; 29/857, 861, 863, 876

[56] References Cited

U.S. PATENT DOCUMENTS

| | | | |
|---|---|---|---|
| 2,016,441 | 10/1935 | Kelley | 439/888 |
| 4,157,207 | 6/1979 | Robinson | 439/888 |
| 4,824,390 | 4/1989 | Crane et al. | 439/936 |
| 4,878,851 | 11/1989 | Mullen, III | 439/83 |
| 4,883,431 | 11/1989 | Uken et al. | 439/521 |
| 5,037,333 | 8/1991 | Baubles | 439/888 |
| 5,149,281 | 9/1992 | Hills et al. | 439/936 |
| 5,637,007 | 6/1997 | Suzuki et al. | 439/936 |

*Primary Examiner*—Neil Abrams
*Assistant Examiner*—T C Patel
*Attorney, Agent, or Firm*—Birch, Stewart, Kolasch & Birch, LLP

[57] ABSTRACT

A connector is used to repair an electrical connection between a wire and a terminal of a wire wrap connection. The connector is a conductive tubular member having a plurality of barbs extending inwardly from the sidewall thereof. The connector is insertable over the terminal having the wire wrap connection made thereon. When the connector is inserted onto the terminal, the barbs slide along the surface of the terminal and the wire to establish an electrical connection between the wire and the terminal. The connector may include a gel inside which prevents corrosion of the wire wrap connection.

20 Claims, 4 Drawing Sheets

WIRE WRAP CONNECTION REPAIR DEVICE

BACKGROUND OF THE INVENTION

1. Field of the Invention

The present invention relates to a device for repairing a wire wrap connection, and more particularly, to a connector insertable over the wire wrap connection for restoring an electrical connection between a wire and a terminal.

2. Description of the Background Art

Various ways of connecting a wire to a terminal to establish an electrical connection as well as a mechanical connection are known in the art. For example, screw terminals, solder or spring clips may be used. Another way of establishing both an electrical connection and a mechanical connection is by utilizing a wire wrap connection. A wire wrap connection is made by wrapping a non-insulated portion of a wire around a terminal several times in order to establish both a strong mechanical connection and an electrical connection between the wire and the terminal. The wire may be wrapped around the terminal five to ten times, or more.

Typically, the wire wrap connection is performed with a specialized tool which may be in the form of a pencil-like tool or a gun. With the pencil-like tool, the wire is manually wrapped around the terminal by the movement of the operators hand. The gun, however, automatically performs the wrapping operation. If the gun is not properly calibrated, the wire wrap connection may initially be loosely formed, producing a poor electrical and mechanical connection.

Over time, the wire wrap connection may be exposed to moisture, harmful outdoor elements, temperature changes, and physical stress. The wire wrap connection may therefore become loosened, and provide a poor electrical connection. Further, the moisture and environmental elements may cause the connection to rust or corrode, thereby diminishing the electrical connection between the wire and the terminal. When utilized in a telephone network, such poor connections can produce hissing, and degrade the overall sound quality of the telephone connection.

In order to reestablish the electrical connection to eliminate the undesirable noise, it is necessary for a telephone repair person to remove the wire by unwrapping the connection, cut the wire, strip the insulation from a portion of the remaining wire, and reperform the wire wrapping operation. It may further be necessary to clean the terminal of corrosion before remaking the wire wrap connection. This method is very time consuming, and may even be impossible if there is not enough slack in the existing wire to remake the wire wrap connection.

There is a need in the art for a repair kit including a device which can quickly and easily reestablish an electrical connection between the terminal and the wire, thereby reducing or eliminating any electrical noise caused by a poor wire wrap connection. There is also a need in the art for a device which will prevent future corrosion of the wire wrap connection caused by the elements, thereby extending the life of an existing wire wrap connection.

SUMMARY OF THE INVENTION

The present invention fulfills the aforementioned need in the art by providing a connector which can be inserted onto an existing wire wrap connection to reestablish an electrical connection between the terminal and the wire. The connector comprises an electrically conductive tubular member having a plurality of barbs extending inwardly therefrom. Some of the barbs engage the wire, while others of the barbs engage the terminal to establish an electrical connection between the terminal and the wire through the tubular member. The connector may include a non-conductive silicone-based gel therein which isolates the connection from moisture and prevents corrosion of the wire wrap connection caused by the elements.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
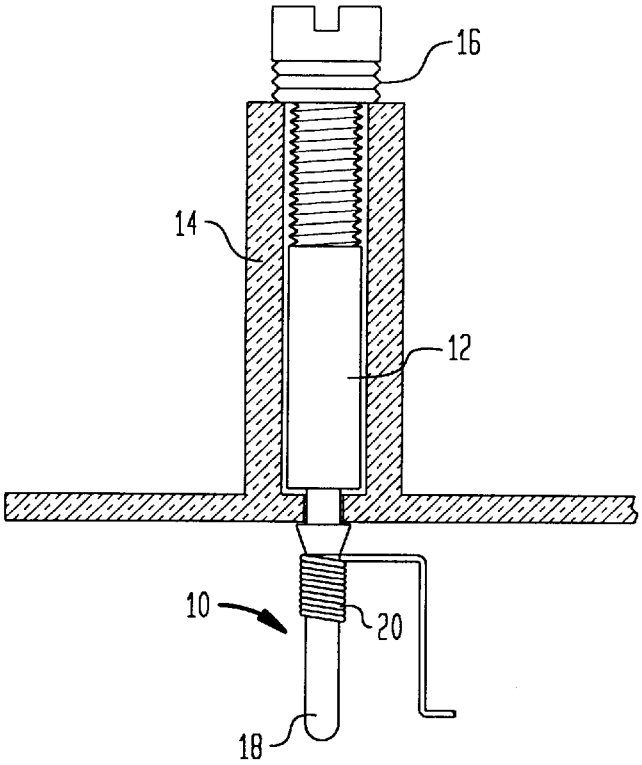
FIG. 1 (BACKGROUND ART)
FIG. 1 is a side view of a wire wrap connection of the background art.

Referring in detail to the drawings, and with particular reference to FIG. 1, a wire wrap connection 10 of the prior art is shown. A conductive terminal post 12 is supported by a support member 14, which is preferably made of an insulative material. The upper end of the terminal post 12 includes a threaded screw connector 16 for releasably securing a wire (not shown) to the upper end of the terminal post 12. The lower end of the terminal post 12 includes a terminal 18 around which a wire coil 20 is wound to produce the wire wrap connection 10.

Figure 2:
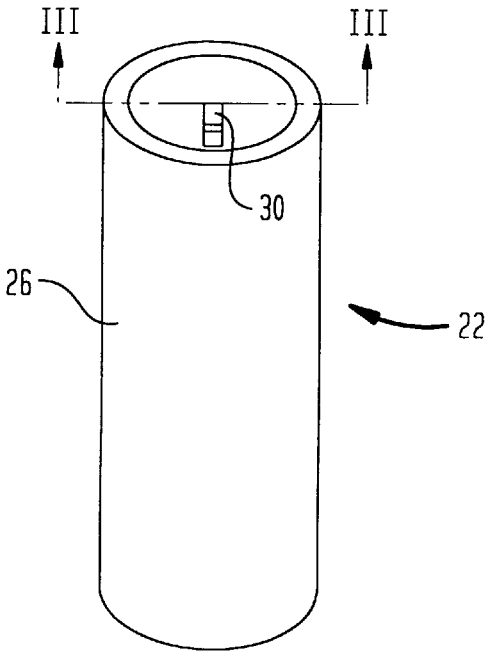
FIG. 2 is a perspective view of the connector of the present invention.

Referring now to FIG. 2, a connector 22 according to the present invention will be described. The connector 22 includes a tubular member 24 comprising a cylindrical sidewall 26 and a bottom wall 28. The tubular member 24 is preferably made of a conductive material such as metal.

Figure 3:
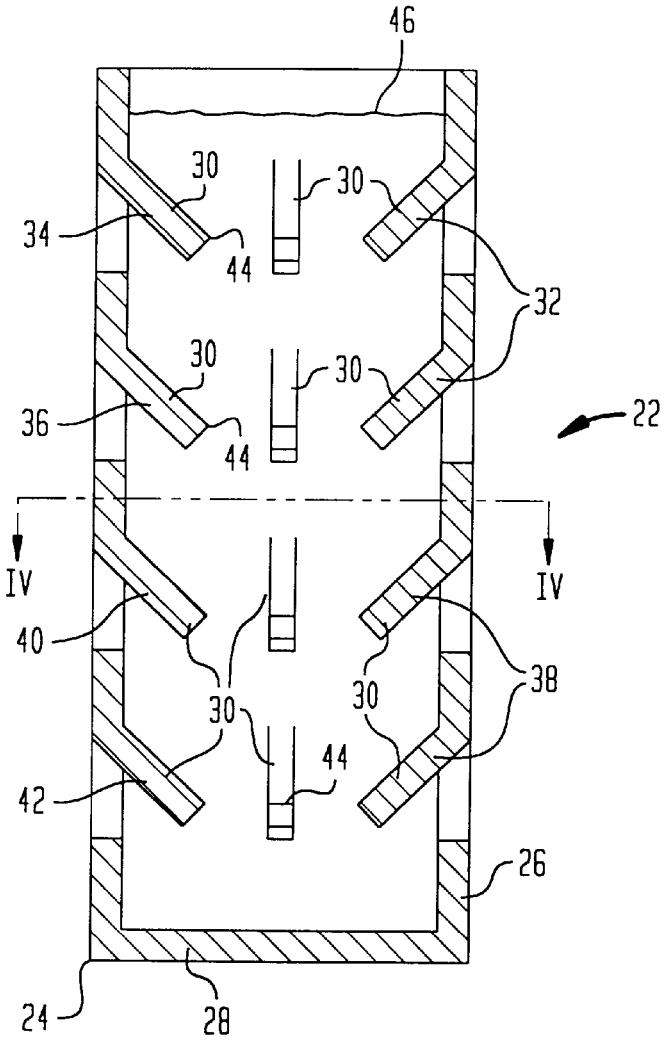
FIG. 3 is a cross-sectional side view of the connector of the present invention taken along line III—III in FIG. 2.

As shown in FIG. 3, a plurality of barbs 30 extend inwardly from the interior of the sidewall 26. The barbs 30 are preferably formed as cut-away portions of the sidewall 26 which have been bent inwardly into the interior of the tubular member 24.

Several sets of barbs 30 extend from the sidewall 26. A first set 32 of barbs 30 is located nearest to the open end of the tubular member 24. The first set 32 of barbs 30 is engagable with the wire coil 20 to establish an electrical connection between the first set 32 of barbs 30 and the wire coil 20. The first set 32 of barbs preferably includes two rows 34,36 of barbs 30 extending around an inner periphery of the sidewall 26 of the tubular member 24.

A second set 38 of barbs 30 is located nearest to the bottom wall 28 of the tubular member 24. The second set 38 of barbs 30 is engagable with the terminal 18 to establish an electrical connection between the second set 38 of barbs 30 and the terminal 18. The second set 38 of barbs preferably includes two rows 40,42 of barbs 30 extending around an inner periphery of the sidewall 26 of the tubular member 24.

Figure 4:
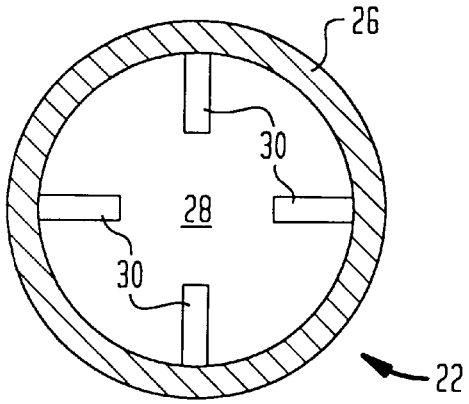
FIG. 4 is a cross-sectional end view of the connector of the present invention taken along line IV—IV in FIG. 3.

In the preferred embodiment, each of the rows 34,46,40, 42 includes four barbs 30 spaced equidistant around the inner circumference of the cylindrical sidewall 26, as shown in FIG. 4. However, it is contemplated that more or fewer barbs 30 may be utilized, and the spacing between the barbs 30 may be varied.

Each of the barbs 30 extends from the sidewall 26 at an acute angle with respect to the sidewall 26, and is directed toward the bottom wall 28 of the tubular member 24. Further, each of the barbs 30 has a certain amount of resilience due to the springy nature of the material forming the barbs 30, which are preferably made of metal.

Figure 5:
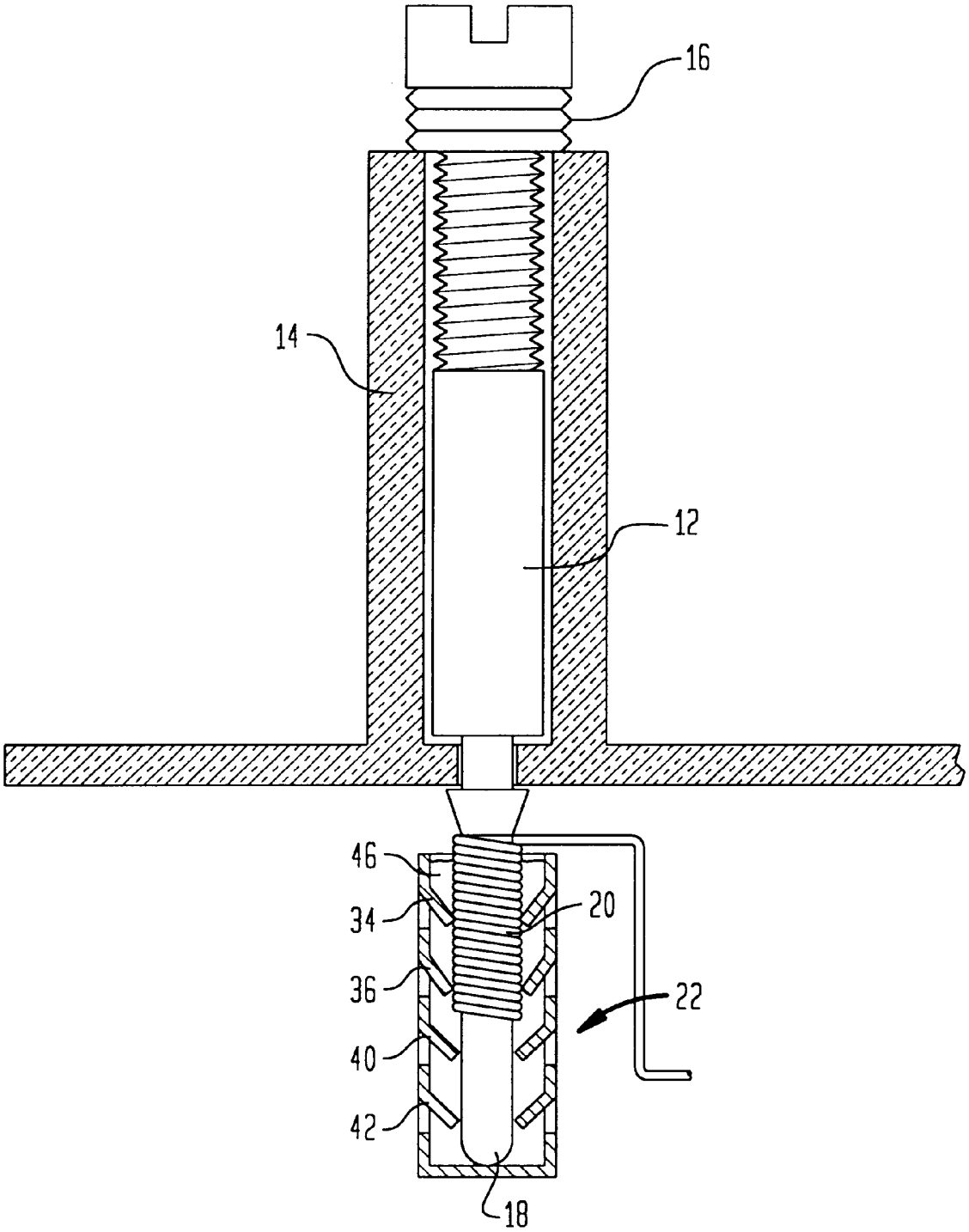
FIG. 5 is a side view of the connector of the present invention in an installed position on a wire wrap connection.

Referring now to FIG. 5, the angular orientation and resilience of the barbs 30 allow the connector 22 to be inserted onto the terminal 18 such that the barbs 30 deflect to conform to the outer periphery of the terminal 18 and the wire coil 20. The distal edge 44 of the barbs 30 scrape along the surface of the terminal 18 and the wire coil 20 to expose and contact a bare metal portion of the terminal 18 and the wire coil 20. The angular orientation of the barbs 30 also prevents the connector 22 from inadvertently coming off of the terminal 18.

As shown in FIG. 5, the barbs 30 in the first two rows 34,36 engage the wire coil 20, and the barbs 30 in the second two rows 40,42 engage the terminal 18 to establish an electrical connection between the terminal 18 and the wire coil 20 through the tubular member 24 of the connector 22.

Depending on the stiffness of the barbs 30, the connector 22 may be installed onto the terminal 18 by hand or with the aid of a driving device, such as a hammer. The connector 22 can be inserted until the bottom wall 28 of the tubular member 24 contacts the end of the terminal 18, thereby preventing further movement of the connector 22, and preventing damage to the wire by the open end of the connector 22.

Because the barbs 30 expose bare metal portions on the terminal 18 and the wire coil 20, these bare metal portions are susceptible to corrosion and rust from moisture in the air. In order to prevent this oxidation of the bare metal parts, the tubular member 24 preferably includes a gel 46 in the interior thereof. The gel 46 is a nonconductive silicone-based gel which isolates the connection from moisture. Preferably, the gel completely covers and encapsulates the wire coil 20 and the terminal 18.

Figure 6:
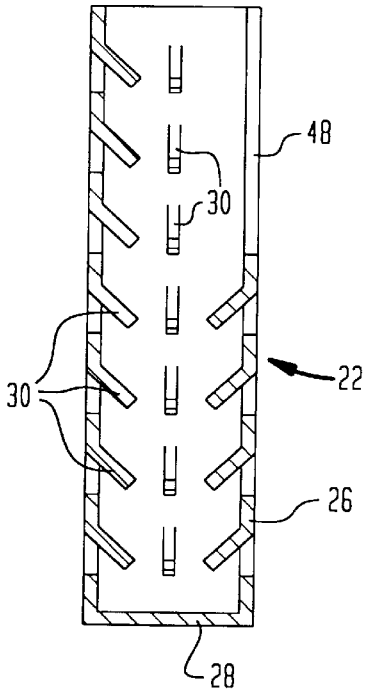
FIG. 6 is a cross-sectional side view of an improvement to the connector of the present invention.
Figure 7:
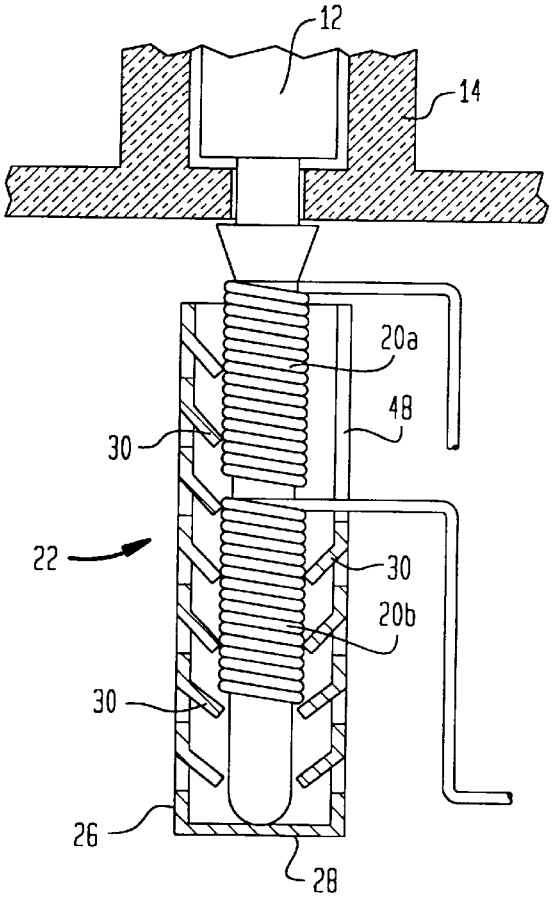
FIG. 7 is a side view of the connector of FIG. 6 in an installed position on a double wire wrap connection.

A modification to the connector 22 is shown in FIGS. 6 and 7. The terminal 18 shown in FIG. 7 includes two wire coils 20*a*,20*b* wrapped thereon. The length of the tubular member 24 may be increased to accommodate additional wire coils 20 or an increased length of the terminal 18. However, in order to prevent damage to the wire leading from the wire coil 20*b*, the tubular member 24 includes a longitudinal slit 48 in the sidewall 26 for the wire to pass therethrough.

Although the embodiments illustrated include a terminal post 12 having a threaded screw connector 16 at one end thereof, it should be understood that the present invention may be applied to any wire wrap connection. Such wire wrap connections may be present on other types of terminals, or may be present as part of a connection to discrete components on a circuit board.

Wire wrap connections are utilized in a variety of application other than the telephone network industry, and the connector of the present invention would be useful in any of these other applications. Depending on the application, it may be necessary to have an insulated connector to prevent electrical shock or shorting. Therefore, the tubular member may include an insulating material on an exterior surface thereof. Also, while a non-conductive gel is utilized in the preferred embodiment to prevent undesirable shorting of adjacent terminals if the gel were to leak out of the connector, it is conceivable that a conductive gel may be utilized in other applications to further enhance the conductance between the terminal and the wire.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A connector for establishing an electrical connection between a terminal and a wire of a wire wrap connection, the wire being wrapped about the terminal, the connector comprising:

an electrically conductive tubular member; and a plurality of barbs extending inwardly from said tubular member, at least a first of said barbs engagable with said wire and at least a second of said barbs engagable with said terminal to establish said electrical connection between said terminal and said wire through said tubular member.

2. The connector as set forth in claim 1, wherein said plurality of barbs includes a first set of barbs extending around an inner periphery of said tubular member and engagable with said wire, and a second set of barbs extending around an inner periphery of said tubular member and engagable with said terminal.

3. The connector as set forth in claim 2, wherein said first set of barbs comprises at least two rows of barbs extending around an inner periphery of said tubular member, and said second set of barbs comprises at least two rows of barbs extending around an inner periphery of said tubular member.

4. The connector as set forth in claim 1, wherein said barbs are oriented at an acute angle with respect to the tubular member which prevents the connector from coming off of the terminal.

5. The connector as set forth in claim 1, wherein said barbs are biased inwardly toward a center of said tubular member.

6. The connector as set forth in claim 1, wherein said tubular member is a right circular cylinder.

7. The connector as set forth in claim 1, wherein said tubular member includes a longitudinal slit therein for said wire to pass therethrough.

8. The connector as set forth in claim 1, wherein the tubular member includes a bottom engagable with an end of said terminal for limiting insertion of the connector onto the terminal.

9. The connector as set forth in claim 1, wherein said tubular member includes a gel therein.

10. The connector as set forth in claim 9, wherein the gel isolates the connection from moisture.

11. The connector as set forth in claim 9, wherein said gel is a silicone-based gel.

12. The connector as set forth in claim 9, wherein said gel is non-conductive.

13. A connector for establishing an electrical connection between a terminal and a wire of a wire wrap connection, the wire being wrapped about the terminal to form a wire coil, the connector comprising:

a plurality of conductive barbs, at least a first of said barbs engagable with said wire coil and at least a second of said barbs engagable with said terminal; and a conductive material interconnecting said first barb to said second barb, said electrical connection being established between said terminal and said wire coil through said first and second barbs and said conductive material.

14. The connector as set forth in claim 13, wherein said conductive material is a tubular housing.

15. The connector as set forth in claim 14, wherein said barbs extend inwardly from said tubular housing.

16. The connector as set forth in claim 14, wherein said plurality of barbs includes a first set of barbs extending around an inner periphery of said tubular housing and engagable with said wire coil, and a second set of barbs extending around an inner periphery of said tubular housing and engagable with said terminal.

17. The connector as set forth in claim 16, wherein said first set of barbs comprises at least two rows of barbs extending around an inner periphery of said tubular housing, and said second set of barbs comprises at least two rows of barbs extending around an inner periphery of said tubular housing.

18. The connector as set forth in claim 14, further comprising a non- conductive gel located in an interior of said tubular housing.

19. A method of establishing an electrical connection between a terminal and a wire coil of a wire of a wire wrap connection, the wire being wrapped about the terminal to form a wire coil, the method comprising the following steps:

providing a connector having a conductive tubular body with a plurality of barbs extending inwardly therefrom, and placing the connector onto the terminal such that the barbs slide along the surface of the terminal and the wire coil to establish an electrical connection between the terminal and the wire coil through the connector.

20. The method as set forth in claim 19, further comprising the step of placing gel inside of said tubular body.

* * * * *